US005905243A

United States Patent [19]

Zehnder et al.

[11] Patent Number: 5,905,243

[45] Date of Patent: May 18, 1999

[54] POWER BREAKER

[75] Inventors: Lukas Zehnder, Baden-Dättwil; Kurt Kaltenegger, Lengnau; Benedikt Löpfe, Zürich; Lorenz Müller, Gebenstorf; Manfred Seidel, Fislisbach, all of Switzerland

[73] Assignee: Asea Brown Boveri AG, Baden, Switzerland

[21] Appl. No.: 08/919,213

[22] Filed: Aug. 28, 1997

[30] Foreign Application Priority Data

Oct. 9, 1996 [DE] Germany ..... 196 41 550

[51] Int. Cl.[6] ..... H01H 33/70

[52] U.S. Cl. ..... 218/54; 218/62; 218/64

[58] Field of Search ..... 218/1–8, 11, 13, 218/43, 46, 48–57, 59–65, 68, 72–77, 146

[56] References Cited

U.S. PATENT DOCUMENTS

| | | | |
|---|---|---|---|
| 3,855,436 | 12/1974 | Marin | 200/148 R |
| 4,032,737 | 6/1977 | Huhse et al. | 200/148 R |
| 5,728,988 | 3/1998 | Meinherz et al. | 218/65 |

FOREIGN PATENT DOCUMENTS

| | | | |
|---|---|---|---|
| 0163943B1 | 12/1985 | European Pat. Off. | H01H 33/98 |
| 0313813B1 | 5/1989 | European Pat. Off. | H01H 33/91 |
| 2211617 | 9/1973 | Germany | H01H 33/74 |
| 3321740A1 | 11/1984 | Germany | H01H 33/915 |
| 4103119A1 | 8/1992 | Germany | H01H 33/915 |
| 4200896A1 | 7/1993 | Germany | H01H 33/12 |
| 4211158A1 | 10/1993 | Germany | H01H 33/12 |
| 29509015U1 | 9/1995 | Germany | H01H 33/915 |
| 4427163A1 | 2/1996 | Germany | H01H 33/42 |

*Primary Examiner*—Michael A. Friedhofer

*Attorney, Agent, or Firm*—Burns, Doane, Swecker & Mathis, L.L.P.

[57] ABSTRACT

This power breaker has an arcing chamber which is filled with an insulating medium and extends along a central axis (2). This arcing chamber is provided with a power current path which has two erosion contact arrangements (5, 6) which are arranged on the central axis (2), are at a constant distance from one another in the axial direction and bound an arcing zone. The arcing chamber also has a heating area (13), which is connected to the arcing zone, and a bridging contact which electrically conductively connects the erosion contact arrangements (5, 6) in the connected state. The bridging contact is arranged centrally in the interior of the erosion contact arrangements (5, 6). An annular gap (36) is provided between the erosion contact arrangements (5, 6) and opens directly into the heating area (13). In this power breaker, the flow behavior is significantly improved in the region between the arcing zone and the heating area (13).

19 Claims, 7 Drawing Sheets

FIG. 6a
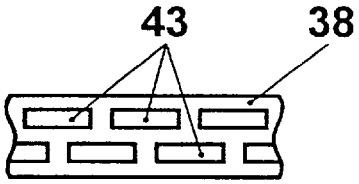
FIG. 6b
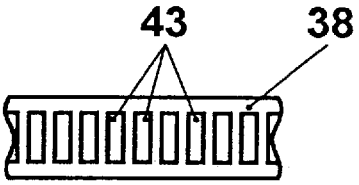
FIG. 6c
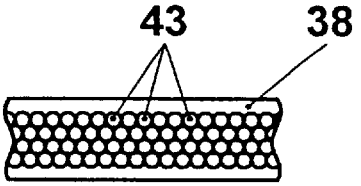
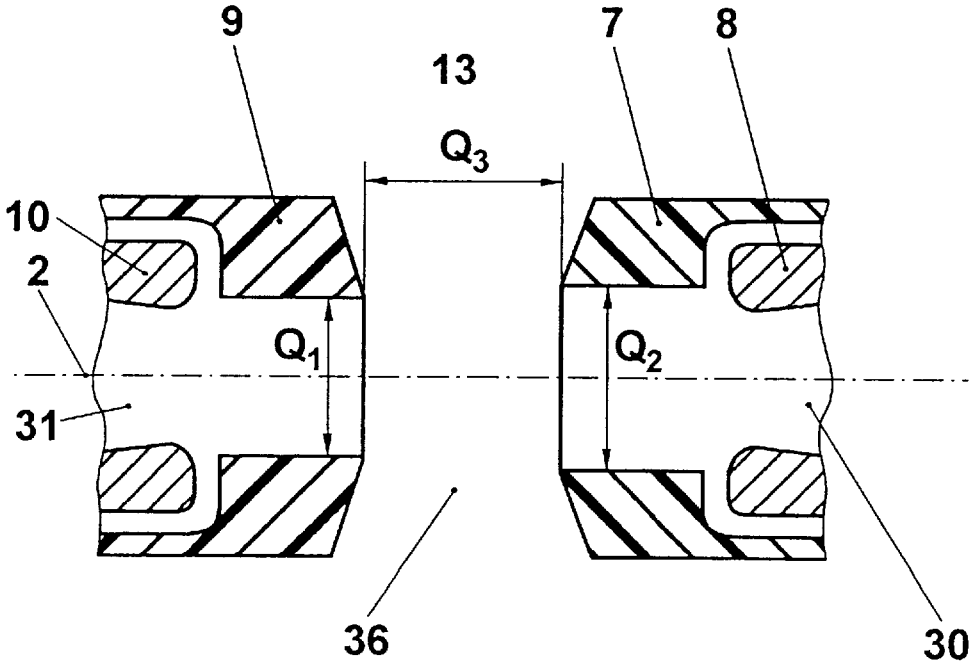
FIG. 7

POWER BREAKER

BACKGROUND OF THE INVENTION

1. Field of the Invention

The present invention relates to a power breaker having at least one arching chamber filled with an insulating medium.

2. Discussion of Background

Patent Specification EP 0 3 13 813 B1 discloses a power breaker whose arcing chamber has erosion contacts, the two of which are moved in opposite directions, to be precise by a drive, which is not illustrated, in conjunction with two toothed racks, which are arranged diametrically opposite one another, and in conjunction with corresponding gear wheels.

Laid-Open Specification DE 42 11 158 A1 discloses a power breaker which has an arcing chamber with two erosion contacts, one of which is designed to be moving. The arcing chamber is filled with an insulating gas, preferably pressurized $SF_6$ gas. Arranged concentrically around the erosion contacts is a rated current path, which carries the current when the arcing chamber is in the connected state. Provided in the interior of the moving erosion contact is a heating area to which hot gas at an increased pressure is applied from the arcing zone of the arcing chamber. The heating area is connected by means of a narrow heating channel to the arcing zone. This heating channel is designed to be comparatively long and has a right-angle bend. This bend impedes the hot gas produced by the arc flowing into the heating area, since it reflects pressure waves. These pressure waves partially block the flow in the direction of the heating area. When the process of blowing out the arc starts, this bend thus also impedes the flow into the arcing zone, therefore somewhat reducing the cooling effect of the blowing process. During disconnection, the heating area is additionally fed with cold gas from a compression area, in a known manner.

Patent Specification EP 0 163 943 B1 discloses a concentrically constructed power breaker which has one power current path which is concentrically surrounded by an axially extending heating area. The power current path has a moving erosion contact and a stationary erosion contact. Located between the erosion contacts and the heating area there is an intermediate area. After contact disconnection, the insulating gas is first of all heated up in the intermediate area by the arc which is then produced. This intermediate area enlarges the arcing zone in this power breaker. The arcing zone in this power breaker is connected by means of an annular gap, which extends radially outwards, to the heating area, which is arranged symmetrically with respect to the annular gap and into which the hot gas produced in the arcing zone flows. The hot gas is temporarily stored in this heating area. The heating area is rigidly connected to the stationary erosion contact. In this embodiment of the power breaker, the cold insulating gas in the heating area is not mixed particularly effectively with the hot gas flowing in during the disconnection process. In addition, the pressure rise in the heating area takes place with a certain time delay, since time is required in advance to heat up the insulating gas in the intermediate area.

Laid-Open Specification DE 42 00 896 A1 discloses a power breaker which has an arcing chamber with an external rated current path and two stationary erosion contacts which are at a distance from one another. The arcing chamber is filled with an insulating gas, preferably pressurized $SF_6$ gas. When the arcing chamber is in the connected state, the two erosion contacts are electrically conductively connected to one another by means of a moving bridging contact. The bridging contact concentrically surrounds the cylindrically designed erosion contacts. The bridging contact and the two erosion contacts form a power current path, which carries current only during the disconnection process. During a disconnection process, the bridging contact slides down from a first of the erosion contacts and strikes an arc which initially burns between the first erosion contact and the end of the bridging contact facing it. As soon as this end reaches the second erosion contact, the base of the arc commutates from the end of the bridging contact onto the second erosion contact, and the arc now burns between the two erosion contacts. The gas which is heated in the arcing zone flows through a long heating channel into a heating area which is arranged in the interior of the bridging contact and where it is temporarily stored. The heating area is additionally fed, in a known manner, with cold gas from a compression area during the disconnection process. The pressurized insulating gas which is required to blow out the arc is then introduced into the arcing zone through the heating channel. The comparatively long heating channel causes considerable flow resistance, and the energy lost because of flow losses is then not available for blowing out the arc.

SUMMARY OF THE INVENTION

Accordingly, one object of the invention is to provide a novel power breaker in which the flow behavior is considerably improved in the region between the arcing zone and the heating area.

Since, in the power breaker according to the invention, the heating area is arranged immediately adjacent to the arcing zone and symmetrically with respect to it, no flow losses occur either when the hot gases flow out into the heating area or when the arc is being blown out from the heating area thus ensuring, on the one hand, that the pressure builds up fast in the heating area and, on the other hand, that the arc is cooled particularly effectively. Because of this special arrangement, the heating area can also be filled with pressurized hot gas better and can store a greater quantity of hot gas, making it possible to blow out the arc more intensively.

The switching pin which is used as the bridging contact is arranged in the interior of the erosion contact arrangements, along the central axis, and can be designed with an advantageously small diameter, and thus with a particularly low mass. This low-mass bridging contact can be accelerated effectively, and reliably braked again at the end of the disconnection movement, by a comparatively small and comparatively cheap drive.

The erosion contact arrangements are arranged in the interior of the mating contact. The external rated current path, in particular its contact fingers and the contact surfaces on which they slide, are thus very well protected against the direct effects of the arc, which advantageously enhances their durability, and thus extends their life. The maintenance intervals for the rated current contacts in the power breaker are thus advantageously extended, so that the availability of the power breaker is considerably improved.

If the hot gas stored for blowing out the arc has fresh insulating gas, which has been compressed by a piston and cylinder arrangement, added to it, then the blowing out effect is advantageously improved.

The guide plate which is arranged in the heating area produces an advantageous vortex and, because of this, particularly good mixing of the hot gas with the compressed insulating gas, which further increases the disconnection capacity of the power breaker. The fact that the heating area is arranged symmetrically with respect to the geometry of the erosion contact arrangements results in the entire heating area being uniformly filled and mixed, so that the entire volume can be used for storing the gas mixture to be provided for blowing out the arc.

The deliberate partial closure of the annular gap between the erosion contact arrangements by means of rings having apertures and made of insulating material also results in the advantage that, on the one hand, disturbing influences caused by the arc are kept away from the heating area and, on the other hand, the hot gas flowing through is effectively swirled, resulting in particularly intensive mixing of the hot gas with the compressed insulating gas in the heating area.

The further refinements of the invention are the subject matter of the independent claims.

The invention, its development and the advantages which can be achieved with it will be explained in more detail in the following text with reference to the drawing, which illustrates only one possible embodiment.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein:

FIGS. 6*a* to 6*c* show further examples of the physical design of the connection between the heating area and the arcing zone, and FIG. 7 shows a further design option for the connection between the heating area and the arcing zone.

In some cases, the front edges have been omitted in the figures, to make them easier to understand. Only those elements required for direct understanding of the invention are illustrated.

DESCRIPTION OF THE PREFERRED EMBODIMENTS

Figure 1:
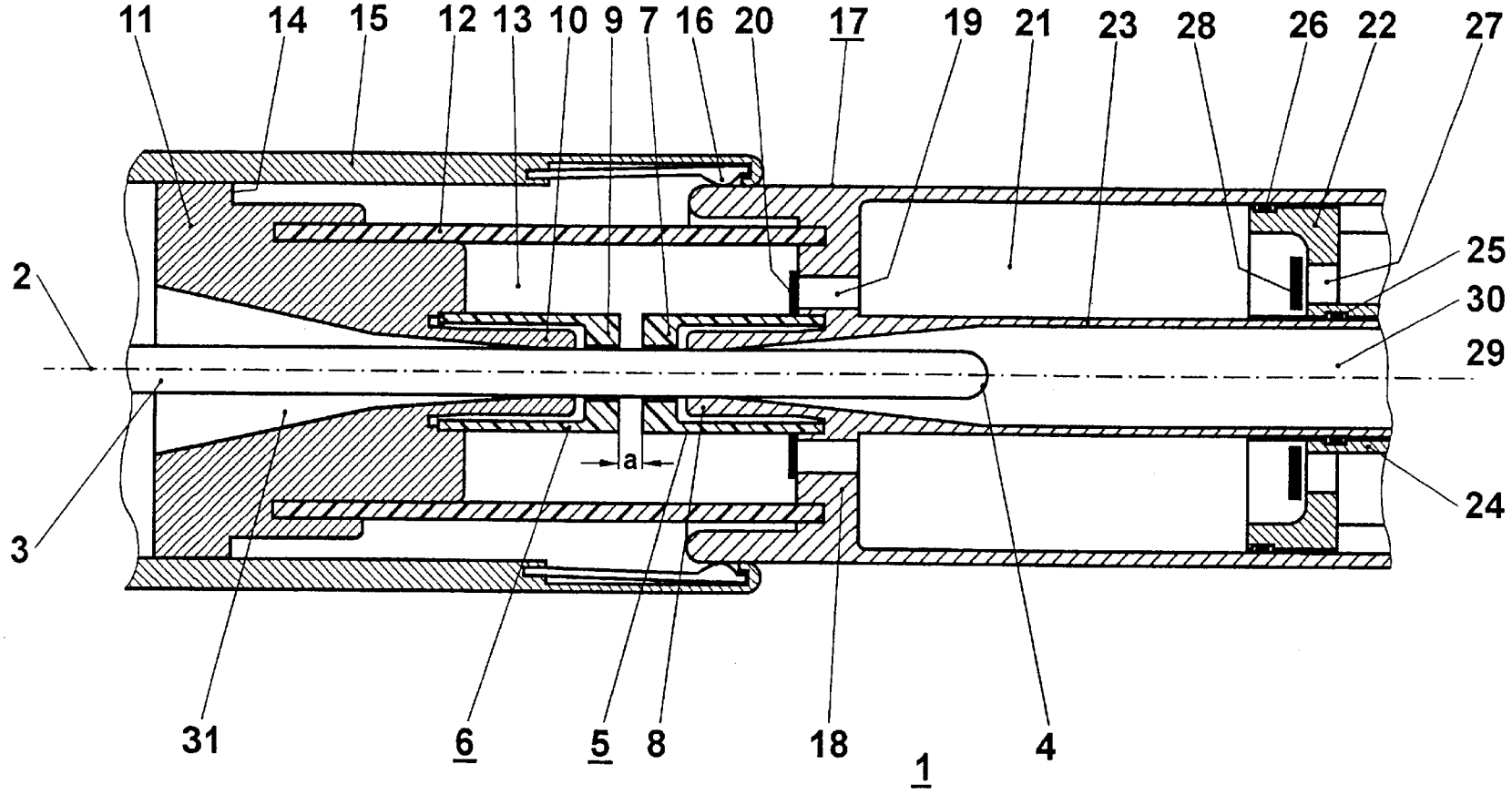
FIG. 1 shows a highly simplified section through the contact zone of a first embodiment of the arcing chamber of a power breaker according to the invention in the connected state.

Referring now to the drawings, wherein like reference numerals designate identical or corresponding parts throughout the several views, FIG. 1 shows a highly simplified section through the contact zone 1 of a first embodiment of the arcing chamber of a power breaker according to the invention in the connected state. This arcing chamber is arranged centrally and symmetrically about a central axis 2. The housing enclosing this contact zone 1 is not illustrated. This housing is filled with an insulating medium, for example pressurized $SF_6$ gas. A centrally arranged, cylindrically designed, metallic switching pin 3 extends along this central axis 2 and can be moved along said central axis 2 by means of a drive which is not illustrated. The switching pin 3 has a tip 4 which is advantageously shaped for dielectric purposes and, if required, can be coated with an electrically conductive, erosion-resistant material. In the connected state, the switching pin 3 electrically conductively bridges a separation distance a, which is designed like an annular gap and is provided between two cylindrically designed, mutually opposite erosion contact arrangements 5 and 6. As a rule, the switching pin 3 is electrically and conductively connected such that it can slide to a first arcing chamber electrical connection, which is not illustrated but is arranged on the left-hand side.

These erosion con-act arrangements 5 and 6 are mechanically rigidly connected to one another and can move together along the central axis 2. During the disconnection process, the power breaker arcing zone is provided between the erosion contact arrangements 5 and 6, and to some extent in its inner hole. The erosion contact arrangement 5 has a cap 7 which is made of a temperature-resistant insulating material and surrounds a sprung, electrically conductive contact cage 8 which rests on the surface of the switching pin 3. The erosion contact arrangement 6 may be designed in a similar way to the erosion contact arrangement 5 with an electrically conductive contact cage 10 in the interior which is designed to be sprung and rests on the surface of the switching pin 3. The erosion contact arrangement 6 is likewise provided with a cap 9 which is made of a temperature-resistant insulating material and surrounds the contact cage 10. Other versions of erosion contact arrangements are also feasible, such as special erosion contacts which extend forward beyond the contact cages 8 and 10 and prevent erosion of said contact cages 8 and 10. Such erosion contacts are used particularly for high disconnection currents, in order to improve the durability of the contact cages 8 and 10. In principle, it is also possible to design one of the caps 7 or 9 to be electrically conductive, and to use the relevant cap as an erosion contact.

The erosion contact arrangement 6 has a retaining part 11 which is manufactured from a metal and is electrically conductively connected to the contact cage 10. The retaining part 11 is also fitted with a cap 9 and a cylindrically designed insulating tube 12, which is arranged concentrically with respect to the central axis 2, mechanically rigidly connecting the two erosion contact arrangements 5 and 6 and, on the side facing away from the central axis 2, bounds a heating area 13 which surrounds it in an annular shape. The retaining part 11 has a collar 14, which slides in a stationary, metallic contact cylinder 15. The outside of the collar 14, facing the contact cylinder 15, is provided with contact elements which are not illustrated, for example with spiral contacts and the associated guide rings made of plastic, which ensure that current passes from the collar 14 of the retaining part 11 to the contact cylinder 15.

The stationary contact cylinder 15 is rigidly connected on the left-hand side to the first arcing chamber electrical connection, which is not illustrated. The contact cylinder 15 is provided in the region located radially outside the insulating tube 12 with sprung contact fingers 16, one side of which is rigidly connected to the contact cylinder 15, for example by means of soldering or by means of swaging or peening. These contact fingers 16 are a part of the rated current path. The sprung ends of the contact fingers 16 are located, when the arcing chamber is connected, on the outside of a cylindrically designed rated current contact tube 17, which can move along the central axis 2 and is designed to be electrically conductive, thus ensuring that current is carried satisfactorily between the rated current contact tube 17 and the contact cylinder 15. The rated current contact tube 17 is rigidly connected on the right-hand side, by means of sliding contacts which are not illustrated, to a second arcing chamber electrical connection, which is likewise not illustrated.

The rated current contact tube 17 is constructed in a dielectrically advantageous manner on the side facing the contact cylinder 15. An electrically conductive cylinder base 18 is incorporated in the rated current contact tube 17 on this side. The contact cage 8 is integrally formed in an electrically conductive manner on this cylinder base 18 and extends in the direction of the erosion contact arrangement 6. The cap 7 is fixed in the cylinder base 18 and the insulating tube 12 is held on this side of the heating area 13, likewise by the cylinder base 18. As a rule, the heating area 13 is arranged symmetrically with respect to the separation distance a, which is shaped like an annular gap. The cylinder base 18 has apertures 19 incorporated in it, which can be closed by means of a schematically illustrated check valve 20 such that the pressurized hot gas stored in the heating area 13 during the arcing chamber disconnection process cannot escape through these apertures 19.

An annular compression area 21 is incorporated in the rated current contact tube 17. The compression area 21 is bounded on one side by the cylinder base 18 and on the other side by a stationary compression piston 22. The compression piston 22 carries the rated current contact tube 17, which slides on it, and this cylindrical sliding surface at the same time bounds the compression area 21 on the outside in the radial direction. A tube 23 which extends towards the compression piston 22 is integrally formed in a pressure tight manner on the cylinder base 18 and bounds the compression area 21 radially on the inside.

The tube 23 slides in the interior of the piston rod 24, which is fitted with the compression piston 22. A sliding seal 25 which is inserted in the piston rod 24 seals the compression area 21 at this point. The sliding seal 26 which is inserted into the outer cylinder surface of the compression piston 22 seals the compression area 21 at this point. The sliding seals 25 and 26 are designed such that the mating contact 17 is not metallically in contact with the compression piston 22 or the piston rod 24, so that no stray currents can flow via the compression piston 22. Apertures 27 are incorporated in the compression piston 22 and can be closed by means of a schematically illustrated check valve 28 such that the pressurized gas produced in the compression area 21 during the arcing chamber disconnection process cannot escape through these apertures 27. If the check valve 28 is open, then the compression area 21 is connected to the arcing chamber area 29 which surrounds the illustrated contact zone 1 and is itself surrounded by the arcing chamber housing, which is not illustrated. The internal volume 30 of the tube 23 is connected to the arcing chamber area 29, in the same way as an area 31 which is surrounded by the retaining part 11.

Figure 2:
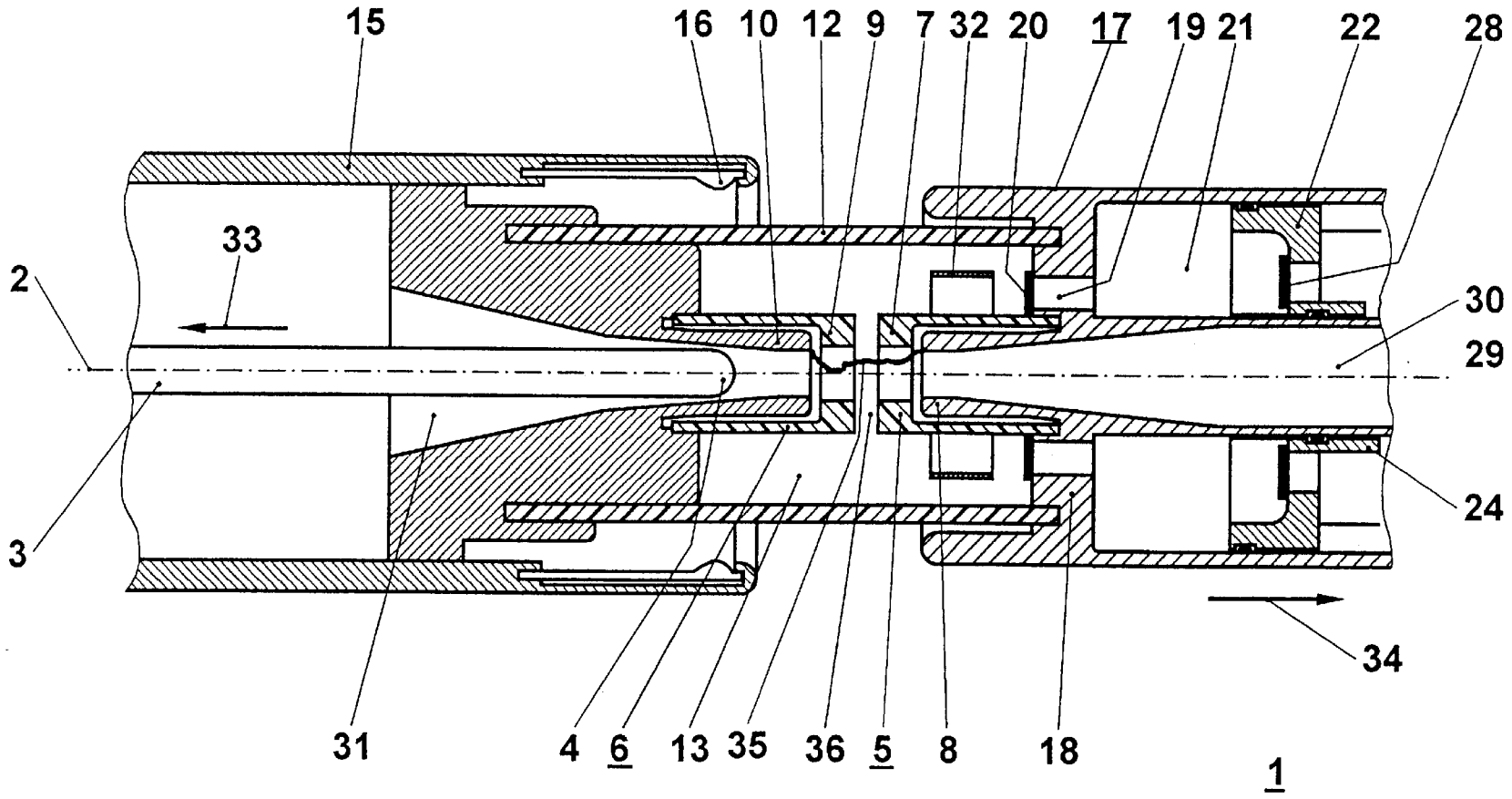
FIG. 2 shows a highly simplified section through the contact zone of a second embodiment of the arcing chamber of a power breaker according to the invention during the disconnection process.

FIG. 2 shows an embodiment of the contact zone 1 that is somewhat modified from that in FIG. 1, to be precise, an annular guide plate 32 being fitted in the region of the check valve 20 in the interior of the heating area 13, which guide plate 32 concentrically surrounds the erosion contact arrangement 5 and ensures that the cold gas, which may flow in through the check valve 20, is swirled with the hot gas stored in the heating area 13. This guide plate 32 may be provided with appropriate guide vanes, or may have other components which influence the gas flow. The other components which form part of the contact zone 1 are designed in the same way as the components illustrated in FIG. 1.

The position illustrated in FIG. 2 shows the arcing chamber during the disconnection process. The external rated current path was interrupted first, and the disconnection current then commutated to the internal power current path. During disconnection, the switching pin 3, which is part of the power current path, is moved to the left, as indicated by an arrow 33, and the rated current contact tube 17, which is part of the rated current path, at the same time moves to the right, as indicated by an arrow 34. When the contact zone 1 is in the position shown, the switching pin 3 no longer bridges the erosion contact arrangements 5 and 6, and the contact cages 8 and 10, that is to say the power current path is already interrupted and an arc 35 which is struck by the switching pin 3 burns between the contact cages 8 and 10. Some of the hot gases produced by the arc 35 flow through the annular gap 36 between the two insulating caps 7 and 9 into the heating area 13.

Figure 3:
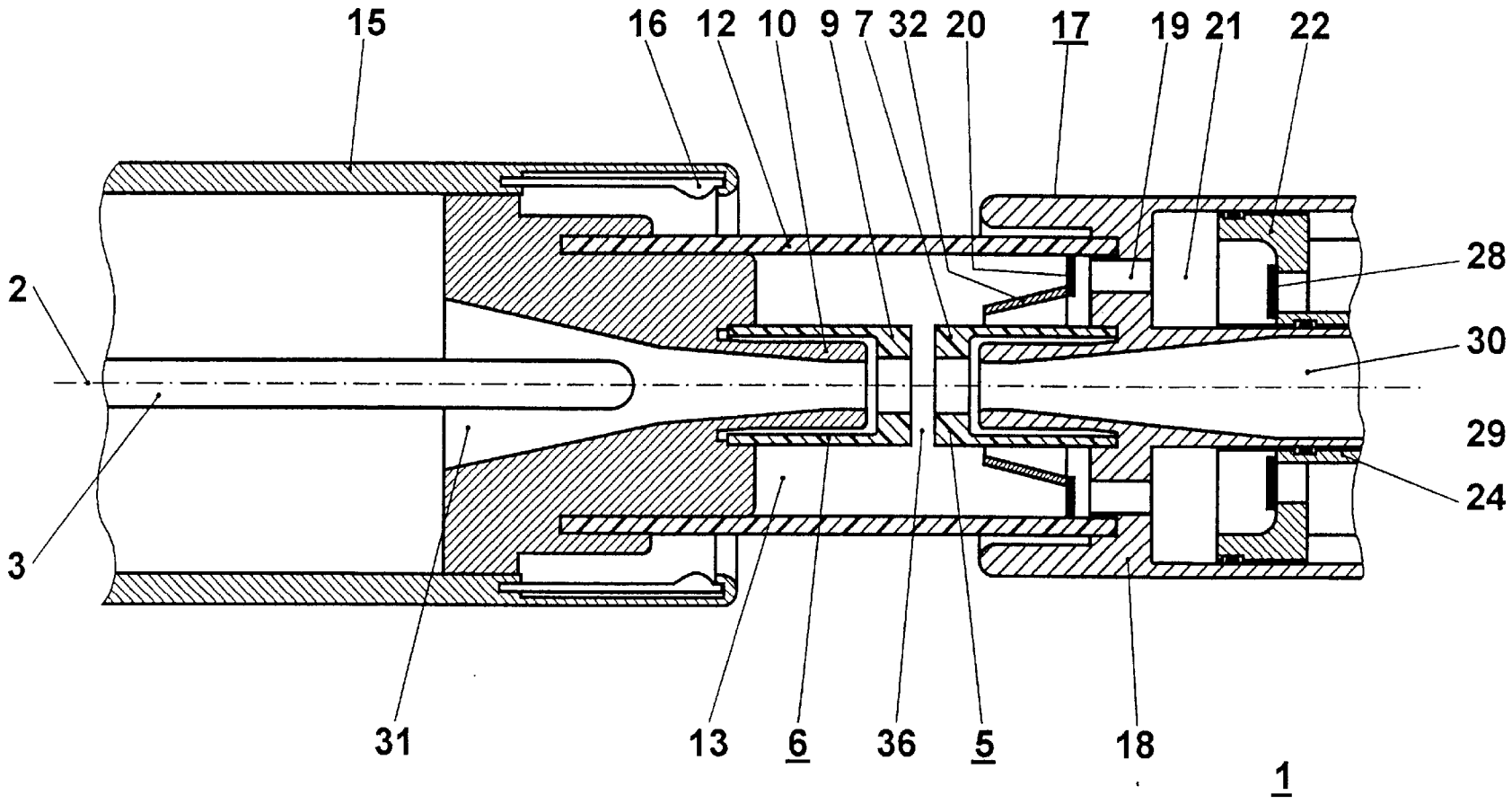
FIG. 3 shows a highly simplified section through the contact zone of a third embodiment of the arcing chamber of a power breaker according to the invention in the disconnected state.

FIG. 3 shows the arcing chamber in the disconnected position, after the arc has been quenched. In comparison with that shown in FIG. 2, this arcing chamber has a somewhat modified embodiment of the contact zone 1, a guide plate 32, which is designed in the form of a truncated cone, being fitted in the region of the check valve 20 in the interior of the heating volume 13 and concentrically surrounding the erosion contact arrangement 5, ensuring that the cold gas flowing in through the check valve 20 is swirled with the gas stored in the heating area 13. The check valve 20 is illustrated in the open state here. This guide plate 32 may be provided with appropriate guide vanes, or may have other components which influence the gas flow. The other components forming part of the contact zone 1 are of the same design as the components illustrated in FIG. 1.

FIGS. 1 to 3 show a power breaker in which both the rated current contact tube 17 and the switching pin 3 are designed such that they can move. As a rule, the rated current contact tube 17 and the switching pin 3 are moved at the same speed, in mutually opposite directions. Patent Specification EP 0 313 813 B1 specifies, for example, a power breaker having a drive which is used to achieve this described movement profile. However, it is also possible with comparatively little complexity to provide a power breaker in which the rated current contact tube 17 and the switching pin 3 operate at different speeds in opposite directions, matched to the respective operating requirements.

Figure 4:
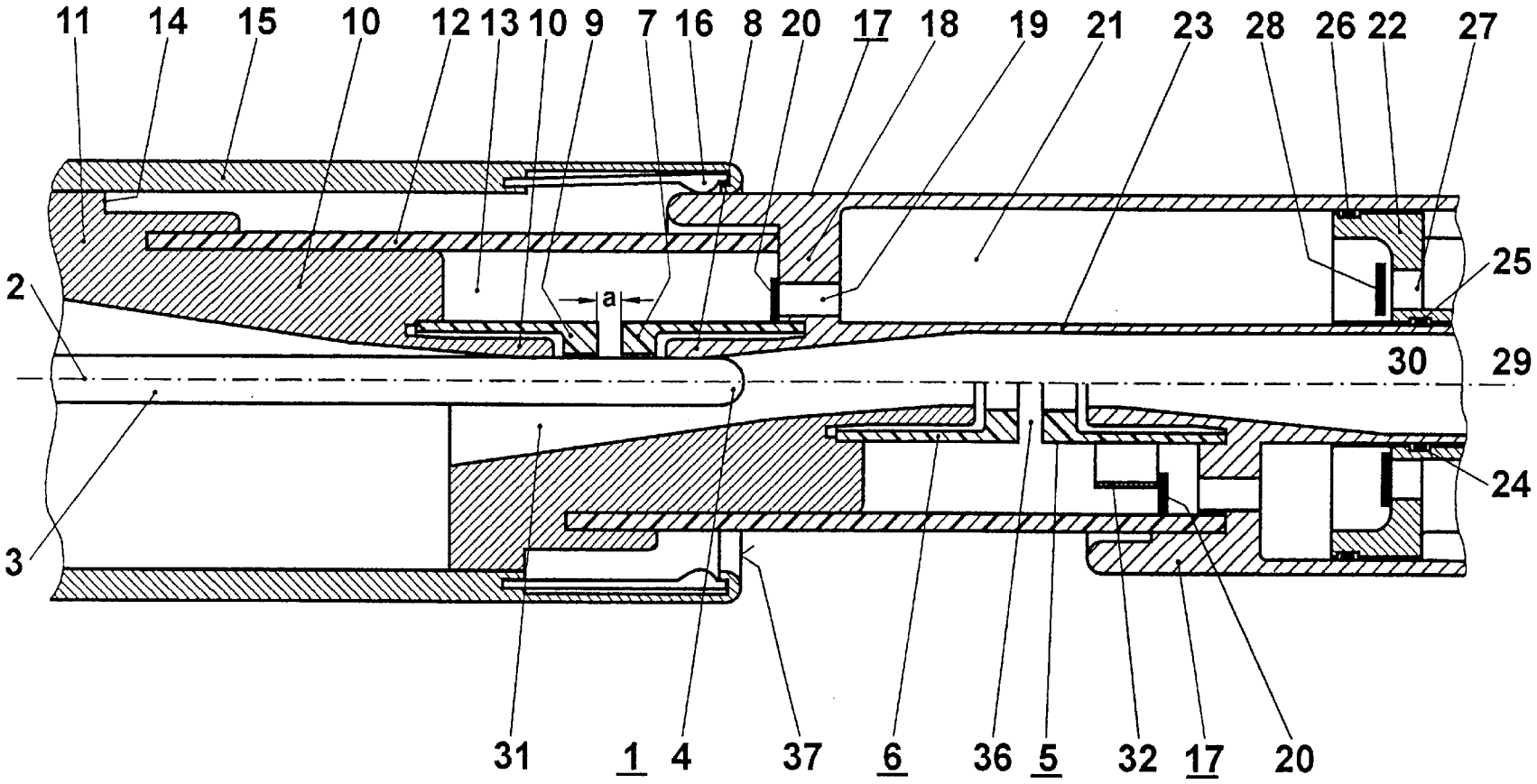
FIG. 4 shows a highly simplified section through the contact zone of a fourth embodiment of the arcing chamber of a power breaker according to the invention, the connected state being shown in the upper half of the figure, and the disconnected state in the lower half of the figure.

Furthermore, it is also possible to equip the power breaker with only one moving contact and if, for example, only a comparatively small disconnection capacity is required, this is completely adequate for a more cost-effective power breaker design. FIG. 4 illustrates a power breaker simplified in this way, which is particularly cost-effective. The basic structure is identical to the power breaker shown in FIG. 1 but the switching pin 3 is designed to be shorter, and its tip 4 no longer projects beyond the front edge 37 of the contact cylinder 15. Here, the switching pin 3 is electrically conductively and rigidly connected to the contact cylinder 15. The contact zone 1 is illustrated in the connected state in the top half of FIG. 4. The contact zone 1 is illustrated in the disconnected state in the bottom half of FIG. 4. The rated current contact tube 17 is moved to the right to its disconnected position. In addition, in the power breaker design shown in the bottom half of FIG. 4, a guide plate 32 is fitted as a modification into the heating area 13. The other components are designed in the same way as the components shown in FIG. 1, so that there is no need for any further description of the contact zone 1 here. As a result of this large number of identical parts for two different power breaker variants, the stockholdings may be worked out in a particularly cost-effective manner.

Figure 5E:
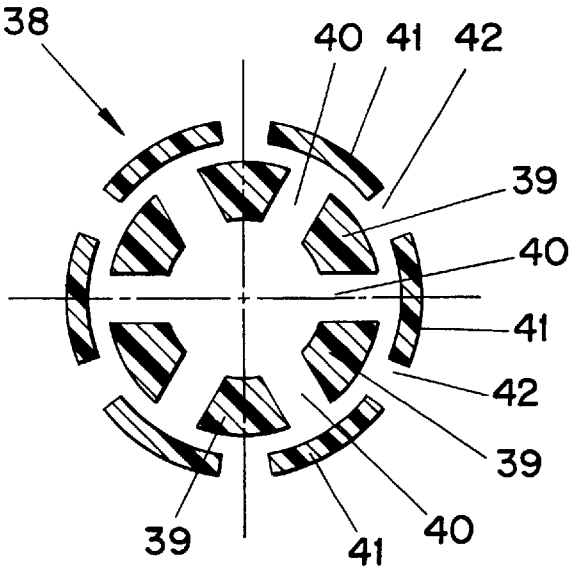
FIG. 5*e* is a cross-sectional illustration of the exemplary embodiment illustrated in FIG. 5*a,*
Figure 5A:
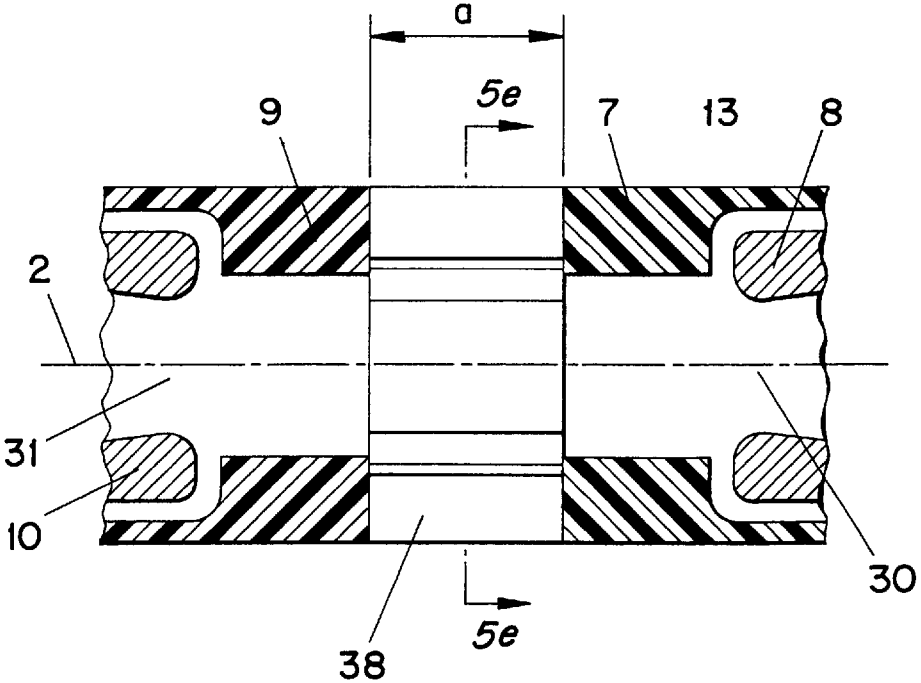
FIGS. 5*a* to 5*d* show a number of examples illustrating how the connection between a heating area and the arcing zone of a power breaker according to the invention can be physically designed.

FIG. 5*a* shows a first design detail of the connection between the heating area 13 and the arcing zone of a power breaker according to the invention. FIG. 5*e* is a cross-sectional view taken along line 5—5 in FIG. 5*a*. The axial separation distance a between the caps 7 and 9 is filled by means of a perforated ring 38 which is fixed to these caps 7 and 9 and is made of a temperature-resistant insulating material. Alternatively, the ring 38 may be integrally formed directly on one of the caps 7 or 9. The ring 38, which is illustrated in cross-section illustrated in FIG. 5*e*, has an inner rim of webs 39, between which radially aligned apertures 40 are arranged. An outer rim of webs 41, which is at a distance from the inner rim and between which radially aligned apertures 42 are arranged, encloses, as a rule coaxially, the inner rim such that the webs 41 cover the apertures 40. This arrangement of webs 39 and 41 provides the advantage that the heat radiation emerging from the arcing zone, as well as the pressure waves caused by the arc, do not act directly on the heating area 13, where they could possibly lead to excessively high pressure rises.

Figure 5B:
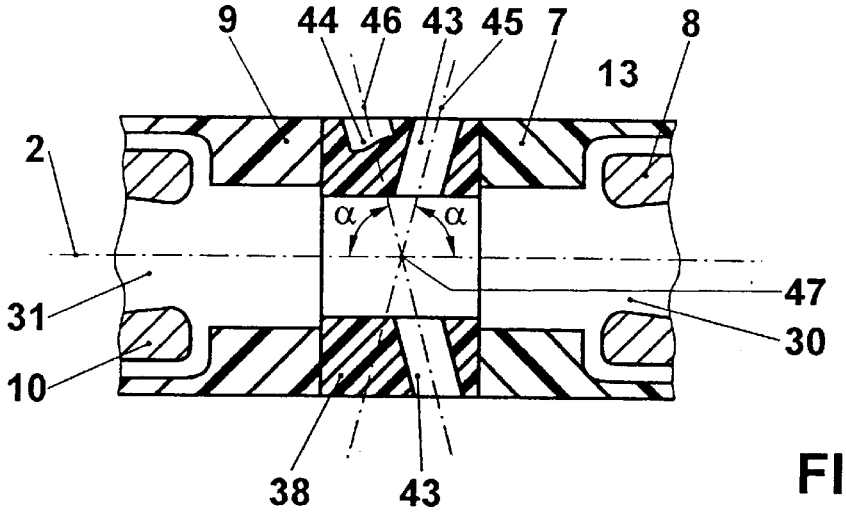
Figure 5C:
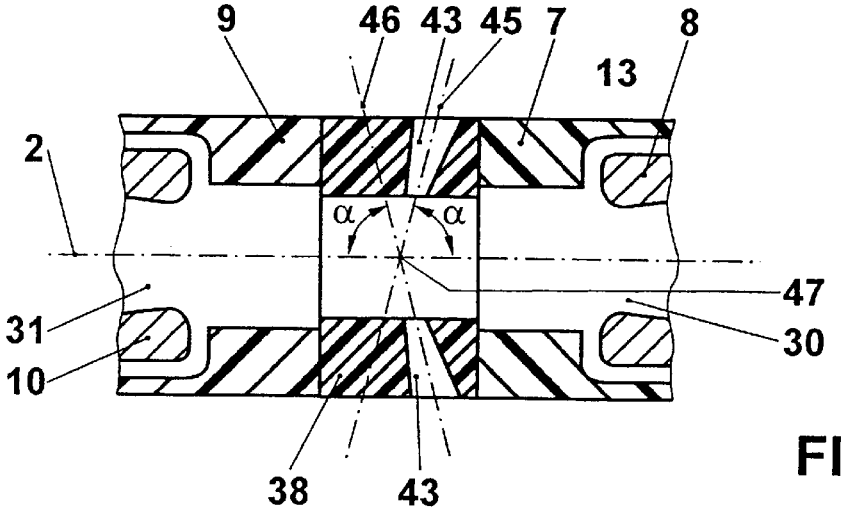

FIG. 5*b* shows a ring 38 which is provided with two rows of holes 43 and 44 which are distributed around the circumference and are offset with respect to one another. These holes 43, 44 each have an axis 45, 46, the axes 45 being assigned to the holes 43, and the axes 46 to the holes 44. The axes 45 and 46 intersect at an intersection 47, which is located on the central axis 2. Each of the axes 45 and 46 is at an intersection angle $\alpha$ to the central axis 2. The intersection angle $\alpha$ preferably has values in the range from 45° to 75°, but other values are also feasible, although, in particular, the axes 45 and 46 need not have the same intersection angle. The intersection angle $\alpha$ of 65° has been found to be particularly advantageous for the present design of the power breaker. The holes 43 and 44 in this version are cylindrical, but it is also possible for these holes 43 and 44 to be conical, as is illustrated in FIG. 5*c*. In this version, holes 43 and 44 expand in the direction of the heating area 13 but, in other respects, they are arranged in the same way as the corresponding holes in FIG. 5*b*.

Figure 5D:
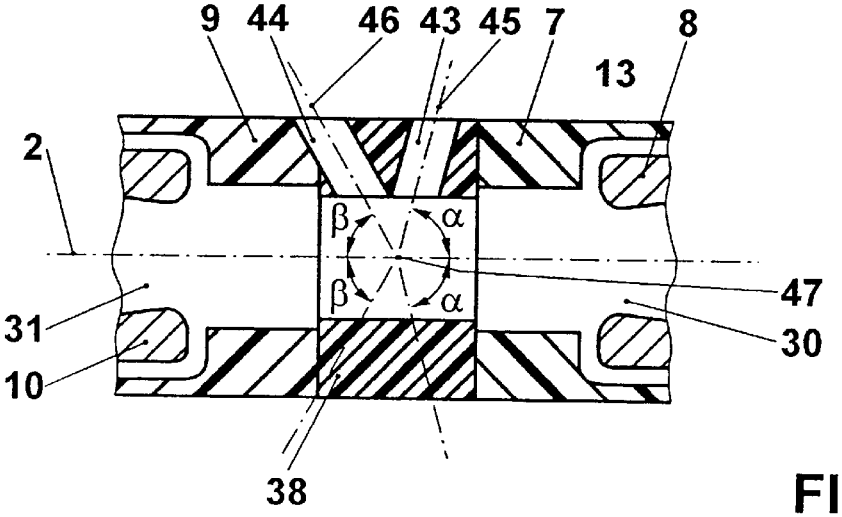

FIG. 5*d* shows a ring 38 which is provided with two rows of holes 43 and 44 which are distributed around the circumference. These holes 43, 44 each have an axis 45, 46, the axes 45 being assigned to the holes 43, and the axes 46 to the holes 44. The axes 45 and 46 intersect at an intersection 47, which is located on the central axis 2. The axis 45 in each case has an intersection angle $\alpha$ with the central axis 2. The axis 46 in each case has an intersection angle $\beta$ with the central axis 2. In this case, the intersection angle $\beta$ is somewhat smaller than the intersection angle $\alpha$. This embodiment is expedient if the heating area 13 is not arranged symmetrically with respect to the annular gap 36. In the example illustrated here, that part of the heating area 13 which is to the left of the annular gap 36, and to the left of the ring 38, turns out to be somewhat larger than the right-hand part. The greater inclination of the holes 44 makes it easier for the hot gas to flow in, so that the intrinsically disadvantageous effects of the said asymmetry of the heating area 13 are at least partially compensated for, which results in improved filling and thus in the heating area 13 having an advantageously greater storage capacity.

FIGS. 6*a* to 6*c* show further design options for the direct connection between the heating area 13 and the arcing zone and, to be precise, they show developments of the ring 38 with further cross section variants of the radial apertures 42 which are possible in principle.

These apertures 42 point radially away from the central axis 2 and have comparatively small cross sections. As a rule, the axes of the apertures 42 are arranged at right angles to the central axis 2, but it is also possible for these axes to intersect the central axis 2 at an angle that is not a right angle. In this case, different apertures 42 in a ring 38 may have different intersection angles. Flow dynamics theory may be used to design the apertures 42 in an advantageous manner in flow terms.

If no ring 38 is provided in the annular gap 36, it has been found to be particularly advantageous in flow terms to design the annular gap 36 such that it expands in the radial direction. If it is intended to produce a particularly high hot gas pressure, the annular gap 36 is designed such that it tapers in the radial direction. A wide range of versions of the annular gap 36 are feasible, so that an optimum shape of the annular gap 36 can be achieved for any of the possible operating requirements.

FIG. 7 shows one example of the shape of the caps 7 and 9, whose mutually facing ends are in this case inclined such that the annular gap 36 widens in the direction of the heating area 13. The cross section $Q_3$, which is designed as a cylinder surface, will, as a rule, satisfy the following condition:

$$Q3/(Q1+Q2)=0.8\sim1.6$$

at the narrowest point in the annular gap 36, matched to the respective operating requirements which are placed on the power breaker.

In this case, the area of the inner opening of the cap 9 at its narrowest point must be used as the cross section $Q_1$, it also being possible in this case for this narrowest point to be in the region of the contact cage 10, depending on the design of said contact cage 10. The area of the inner opening of the cap 7 at its narrowest point must be used as the cross section $Q_2$, it also being possible for this narrowest point to be in the region of the contact cage 8, depending on the design of said contact cage 8. This condition as formulated above is also advantageously taken into consideration in the dimensions of the apertures 40 and 42 and of the holes 43 and 44 in the other design variants. In FIG. 7, the cross sections $Q_1$ and $Q_2$ are illustrated having different sizes, as is always possible in the case of power breakers, and the relationship quoted above is also valid in this case.

In the case of the power breaker variants described here, an external rated current path is provided which leads, in the region of the contact zone 1, from the contact cylinder 15 via the contact fingers 16 and the rated current contact tube 17. For power breakers which are designed for comparatively low rated currents or only for temporary current loads, this rated current path may be omitted, which very much reduces the cost of this power breaker variant. In this case, the power current path which, in this version of the contact zone 1, would extend, for example, from the retaining part 11 via the contact cage 10, the switching pin 3, the contact cage 8 and the tube 23, would at the same time carry the rated current.

It is also feasible, for example, for the contact cage 8 to be connected in series with a blowout coil. The blowout coil forces the arc 35 to rotate and causes an increase in the hot gas pressure in the arcing zone. This is particularly advantageous if the power breaker is designed for particularly low-current disconnection operations, since the rotation increases the thermal effect of the arc 35.

If the power breaker according to the invention is designed for a comparatively low disconnection capacity, then, under some circumstances, it is possible to dispense with the compression area 21, which interacts with the heating area 13, thus resulting in a further, cheap variant of the power breaker.

The figures will now be considered in some more detail, in order to explain the method of operation. During disconnection, the rated current path is always interrupted first, and the disconnection current then commutates onto the power current path. The switching pin 3 then strikes an arc 35, in the course of its disconnection movement, between the contact cages 8 and 10 of the erosion contact arrangements 5 and 6. The length of the arc 35 is therefore essentially governed by the separation distance between the two contact cages 8 and 10, and major fluctuations in the arc length, and fluctuations in the heating power of the arc 35 linked to them, therefore cannot arise in this power breaker so that, when designing the heating area 13, it is possible to assume that the heating power of the arc 35 is dependent only on the instantaneous current level, and can therefore be taken into account easily. The disconnection capacity of this power breaker can in consequence be calculated in advance comparatively easily, so that the extent of the development trials required, and thus the costs incurred in the process as well, can advantageously be reduced.

The disconnection speed is chosen such that the arc 35 burns for only a short time on the tip 4 of the switching pin 3. The tip 4 therefore exhibits hardly any traces of erosion. The contact cages 8 and 10 are made from particularly erosion-resistant material, and therefore have a comparatively long life. The power breaker therefore needs maintenance only comparatively rarely, as a result of which its availability is comparatively high.

As a result of the disconnection movement of the switching pin 3, the arc 35 attains its full length comparatively quickly, this length being governed essentially by the separation distance between the two contact cages 8 and 10, so that the full arc energy is available very shortly after contact separation for pressurizing the insulating gas in the arcing zone which is arranged in the region between the erosion contact arrangements 5 and 6. The arc 35 acts thermally on the insulating gas surrounding it and thus increases the pressure in the arcing zone of the arcing chamber for a short time. The pressurized insulating gas flows through the annular gap 36 into the heating area 13, and is temporarily stored there. However, some of the pressurized insulating gas flows, on the one hand, through the area 30 into the arcing chamber area 29 and, on the other hand, through the area 31 into the arcing chamber area 29. The rated current contact tube 17 contains the piston-cylinder arrangement in whose compression area 21 insulating gas is compressed during the disconnection process. This compressed, fresh insulating gas is introduced through the apertures 19 into the heating area 13 in addition to the thermally produced, pressurized insulating gas.

However, this inward flow takes place only if the pressure in the heating area 13 is lower than in the compression area 21. This is the case, for example, before contact disconnection or before the current zero-crossing of the disconnection current or else if the current in the arc 35 is so weak that it cannot heat the arcing zone sufficiently intensively. However, if a high-current arc 35 heats the arcing zone very severely, so that the pressure of the insulating gas in the heating area 13 is comparatively high, then the compressed gas produced in the piston-cylinder arrangement does not initially flow in at this high pressure. If the stored pressure in the heating area 13 exceeds a predetermined limit, then, once this predetermined limit has been exceeded, an overpressure valve (which is not illustrated) opens and the excess pressure is dissipated directly into the arcing chamber area 29. If the compression pressure in the compression area 21 exceeds a predetermined limit, then, once this predetermined limit has been exceeded, a further overpressure valve (which is not illustrated) opens and the excess compression pressure is dissipated directly into the arcing chamber area 29. This provides a high degree of reliability that unacceptable exceeding of the mechanical load capacity of the components cannot occur in this area. However, if the power breaker is, for example, designed only for comparatively small disconnection currents, it is also possible to dispense with these overpressure valves.

As long as there is overpressure in the arcing zone, very hot ionized gas also flows through the areas 30 and 31 into the arcing chamber area 29. Because the flow cross sections are of similar design, the two gas flows have a similar form, so that the pressure built up in the arcing zone flows away roughly uniformly and in a controlled manner on both sides, as a result of which the hot gas which is present in the heating volume 13 for quenching the arc 35 can be stored under pressure until the arc 35 can be blown out successfully, leading to quenching.

The flow of the hot gas from the arcing zone into the area 31 can be controlled with the aid of the switching pin 3, since the annular flow cross section between the switching pin 3 and the retaining part 11 becomes larger as the travel of the switching pin 3 increases. It is also possible to design the wall of the retaining part 11, which radially bounds the area 31, to achieve the desired optimum flow cross section, depending on the travel.

In the case of the power breaker according to the invention, the heating area 13 is rigidly coupled to the two erosion contact arrangements 5 and 6, so that the heating area 13 is always positioned in the same manner, as a rule symmetrically as well, with respect to the annular gap 36. Throughout the entire disconnection process, that is to say both during the heating-up phase and while the arc 35 is being blown out, this position does not change at all. The flow of the hot gas into the heating area 13 as well as the flow of gas mixture out of the heating area 13 during the blowout phase always takes place in the same manner, because of the constant geometry, so that it is impossible for any fluctuations to occur in the disconnection capacity caused by flow instabilities in the region of the annular gap 36 in the power breaker. The various measures to improve the flow in the region of the annular gap 36 allow the power breaker to be optimally matched to the operating conditions at the respective location where the power breaker is used.

The power breaker according to the invention is particularly suitable for switchboards in the medium-voltage range but it can also be used for high-voltage switchboards if the size of the annular gap 36 and the separation distance between the contact cylinder 15 and the rated current contact tube 17 are modified to correspond to the higher voltage load.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A power breaker comprising:

at least one rotationally symmetrical arcing chamber filled with an insulating medium, said arcing chamber having and extending along a central axis;

at least one power current path;

at least two erosion contact arrangements arranged on said central axis at a constant distance from one another along said central axis, said at least two erosion contacts having an interior and being arranged in said power current path and bounding an arcing zone, said arcing chamber having a heating area in communication with said arcing zone;

a bridging contact electrically conductively connecting said at least two erosion contact arrangements when in a first, connected state, said bridging contact extending along said central axis and being arranged centrally in said interior of said erosion contact arrangements, and an annular gap between said at least two erosion contact arrangements;

wherein said annular gap merges directly into said heating area, said heating area surrounding said at least two erosion contact arrangements;

wherein moving contacts which are located in the rated current path are arranged in a region which is completely isolated from said arcing zone.

2. The power breaker as claimed in claim 1, further comprising a mating contact including a rated current contact tube having an interior, and wherein said at least two erosion contact arrangements are arranged in said interior of said mating contact.

3. The power breaker as claimed in claim 2, wherein said bridging contact comprises a switching pin, and said rated current contact tube and said switching pin can move in opposite directions.

4. The power breaker as claimed in claim 2, wherein said bridging contact is stationary, and said mating contact and said rated current contact tube together comprise a moving contact.

5. The power breaker as claimed in claim 1, further comprising a compression area, and wherein said heating area is operatively connected to said compression area.

6. The power breaker as claimed in claim 5, further comprising means for mixing hot insulating medium with fresh insulating medium provided in said heating area adjacent said compression area.

7. The power breaker as claimed in claim 6, wherein said means for mixing comprises at least one guide plate concentric with said central axis, said means for mixing further comprising a check valve; and wherein said at least one guide plate has a cylindrical or truncated conical shape, said central axis forming the axis of the guide plate.

8. The power breaker as claimed claim 1, wherein said heating area is concentrically arranged around said at least two erosion contact arrangements.

9. The power breaker as claimed in claim 8, wherein said heating area is arranged such that it extends symmetrically along said central axis with respect to said annular gap.

10. The power breaker as claimed in claim 8, wherein said heating area is arranged such that it extends asymmetrically along said central axis with respect to said annular gap.

11. The power breaker as claimed in claim 1, wherein said heating area can move together with one of said at least one erosion arrangements.

12. The power breaker as claimed in claim 1, further comprising a ring positioned in said annular gap including openings therein.

13. The power breaker as claimed in claim 12, wherein said openings comprise apertures which are substantially radially aligned.

14. The power breaker as claimed in claim 12, wherein said ring comprises an inner rim of first webs between which radially aligned first apertures are arranged, and wherein said ring further comprises, at a distance from the inner rim, an outer rim of second webs between which radially aligned second apertures are arranged, said outer rim surrounding said inner rim such that said second webs cover said first apertures.

15. The power breaker as claimed in claim 12, wherein said ring further comprises a circumference and at least two rows of holes which are distributed around said circumference, are offset with respect to one another, are of cylindrical or conical shape, and have axes;

wherein axes have a common intersection which is located on said central axis; and wherein each of said axes are inclined in opposite directions to one another and each intersect said central axis at identical intersection angles.

16. The power breaker as claimed in claim 15, wherein said intersection angles are in the range from 45° to 75°.

17. The power breaker as claimed in claim 12, wherein said ring further comprises a circumference and at least two rows of holes which are distributed around said circumference, are of cylindrical or conical design, and have axes;

wherein said axes have a common intersection which is located on said central axis; and wherein each of said axes are inclined in opposite directions to one another and each intersect said central axis at different intersection angles.

18. The power breaker as claimed in claim 12, wherein said annular gap comprises an annular gap narrowest point, a first one of said at least two erosion contact arrangements comprising an inner opening having a first narrowest point, said first narrowest point having a cross section Q1, a second one of said at least two erosion contacts arrangements comprising an inner opening having a second narrowest point, said second narrowest point having a cross section Q2, and a cross section Q3 of said annular gap at said annular gap narrowest point satisfies the following condition $$Q3/(Q1+Q2)=0.8\sim1.6.$$

19. The power breaker as claimed in claim 1, further comprising a blowout coil connected in series with at least one of said at least two erosion contact arrangements.

* * * * *